United States Patent [19]

Brady

[11] 4,323,249

[45] Apr. 6, 1982

[54] BOARD GAME APPARATUS

[76] Inventor: Hugh D. Brady, P.O. Box 607, Prescott, Ariz. 86301

[21] Appl. No.: 159,966

[22] Filed: Jun. 16, 1980

[51] Int. Cl.[3] ..... A63F 3/00; A63F 9/18

[52] U.S. Cl. ..... 273/249; 273/302

[58] Field of Search ..... 273/236, 242, 243, 248, 273/249, 256, 257, 259, 246, 244, 302; 434/305, 335, 350, 347

[56] References Cited

U.S. PATENT DOCUMENTS

| | | | |
|---|---|---|---|
| 2,823,919 | 2/1958 | Seruggs | 273/246 |
| 3,117,790 | 1/1964 | White | 273/246 |
| 3,939,578 | 2/1976 | Coffey | 273/243 X |
| 4,035,932 | 7/1977 | Massey | 273/249 |
| 4,055,907 | 11/1977 | Henson | 434/335 X |
| 4,078,803 | 3/1978 | Te | 273/248 |
| 4,133,538 | 1/1979 | Ambrose | 273/276 |
| 4,179,822 | 12/1979 | Clark | 434/335 |

FOREIGN PATENT DOCUMENTS

| | | | |
|---|---|---|---|
| 1238838 | 7/1960 | France | 273/254 |

*Primary Examiner*—Richard C. Pinkham
*Assistant Examiner*—Scott L. Brown
*Attorney, Agent, or Firm*—Martin L. Stoneman

[57] ABSTRACT

A game device consisting of a playing board having a "driving" track around the center of the board. The board has multiple lanes, each divided into successive discrete areas bearing players' instructions. The game also includes at least one listing, adapted to have numbered tokens placed thereon, of numbered "defensive driving" tactics. Playing pieces are provided including pieces in the form of cars for movement around the "driving" track in accordance with the roll of a die and game instructions. The players "solve" a plurality of picture cards, each depicting a unique traffic situation calling for certain of the said listed "defensive driving" tactics; and consecutively numbered tokens are provided for selection of the correct tactics in the correct order; and instruction cards are provided for use depending upon the correctness of tactics selected by the player.

10 Claims, 13 Drawing Figures

BOARD GAME APPARATUSCL BACKGROUND OF THE INVENTION

This invention relates to a game device.

More particularly, the invention concerns a board game device of the type including tokens for movement along a designated "track" by each of multiple players.

In a further aspect, the invention concerns a board game device suitable for play by adolescents and adults and designed for instruction in defensive driving tactics while entertaining the players.

Among the board games of the prior art utilizing the movement by players' pieces along sequential areas of a "track" is the game of Monopoly. The combination of chance produced by the throw of a die, and of the skills and learning of financial and investment matters which enable a "win" has been found useful, popular, and longlasting by the playing populace.

SUMMARY OF THE INVENTION

It is the primary object of the present invention to provide an improved game device.

Another object of the present invention is the provision of a board game apparatus adapted for use as a skill game between two or more players.

Still another object is to provide a game device including elements of both chance and skill and providing education for the players in defensive driving skills in traffic situations.

Yet still another object of the present invention is the provision of a board game apparatus of the above type having a high degree of interest and skill for use by the players, which is relatively inexpensive to manufacture, and which has a high degree of durability and serviceability.

Briefly, to accomplish the desired objectives of the present invention in accordance with a preferred embodiment thereof, there is provided a game comprising one or more playing boards; means dividing the playing boards into at least two sectors, the first sector being a "driving" track around the center of a board, the track including a plurality of "driving" lanes. There is included a first means partitioning each lane into a plurality of first discrete areas, the number of these discrete areas in each lane being equal. A second means partitions a second sector of said one or more playing boards into a plurality of second discrete areas. A plurality of second indicia means is provided for identifying each second discrete area, each second indicia means including a unique number in association with a unique described "driving" tactic. There is also provided a first plurality of illustrations, each said illustration depicting a unique traffic situation, and, in association with each said illustration, a listing of the corresponding "defensive driving" tactics called for by said unique traffic situation. Also provided are at least two pluralities of game instruction cards, each plurality being adapted to be shuffled and stacked. Further provided are a plurality of playing pieces adapted to be received in the first discrete areas, each playing piece being visually distinguishable from each other playing piece. Further provided are a plurality of tokens adapted to be received in the second discrete areas; token indicia means for uniquely identifying and numbering each token consecutively; and at least one die. The said one or more playing boards further may include assigned areas for stacking the said pluralities of game instruction cards and other assigned areas for holding playing pieces which are instructed to be removed from the "driving" lanes.

Further, according to a highly preferred embodiment of the present invention, there is provided, in addition to a first playing board having the said first sector (the "driving" track), a plurality of second playing boards each having thereon a said second sector and comprising the lid of a tray constructed, divided, and arranged to hold any game materials of a player of the instant game.

BRIEF DESCRIPTION OF THE DRAWINGS

Further and more specific objects and advantages of the present invention will become readily apparent to those skilled in the art from the following detailed description thereof taken in connection with the drawings, in which.

DETAILED DESCRIPTION OF THE PREFERRED EMBODIMENT

Figure 1:
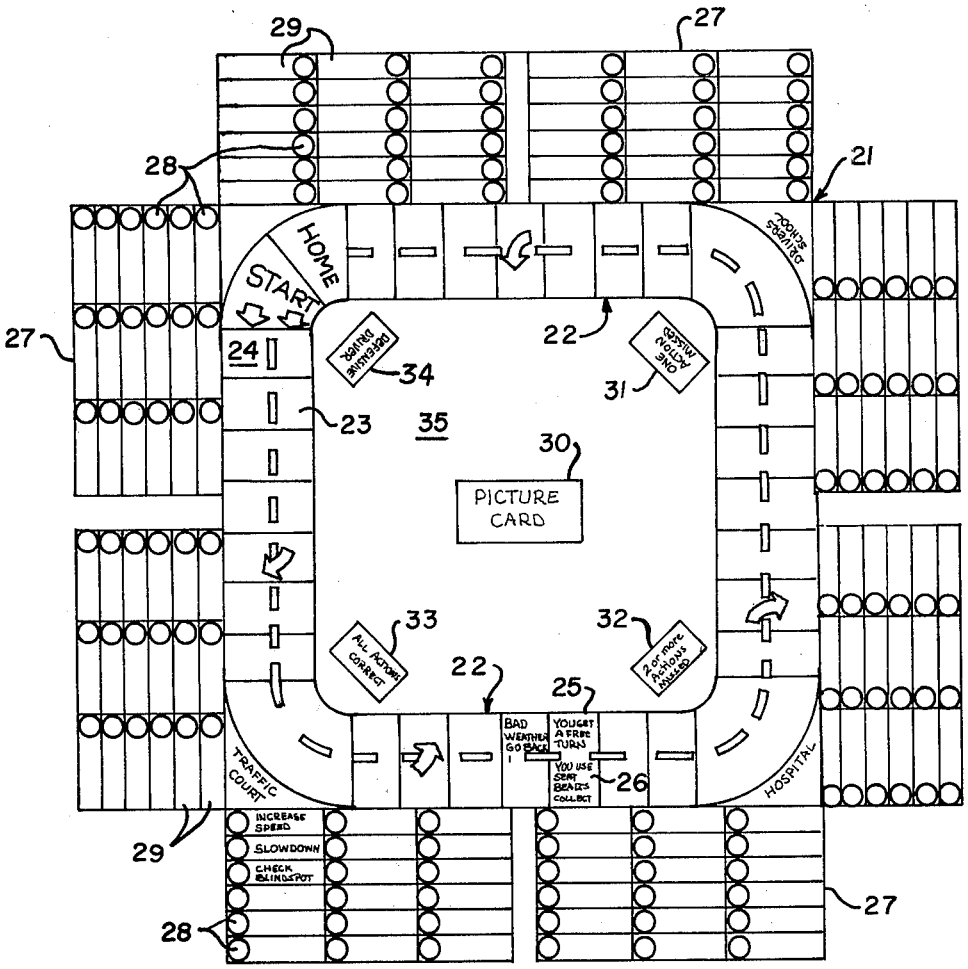
FIG. 1 is a plan view of the surface of a preferred embodiment of the playing board of the present invention.

Turning now to the drawings, in which the reference numerals indicate corresponding elements throughout the several views, FIG. 1 shows a preferred embodiment of the playing board 21 of the present invention. The playing board 21 includes thereon a "driving" track 22, as shown, having two lanes 23 and 24. Lane 23, as shown, includes discrete areas 25 containing game instructions. Similarly, lane 24 includes discrete areas 26, which discrete areas 26 include also game instructions. The "driving" track 22 constitutes a first sector of playing board 21.

A second sector of playing board 21 is comprised by a listing area 27, which listing area 27 is essentially duplicated, as shown, on each side of playing board 21. Each listing area 27 includes a plurality of indicia 28, preferably in the form of numbers, each number 28 being associated with a "driving" tactic set out in each discrete area 29. Each listing area 27 is constructed so as to fold upwardly along its edge with the main part of playing board 21.

Again, with reference to playing board 21, if desired, a playing board area within driving track 22 may be reserved, as shown, as for a picture card area 30 and instruction card areas 31, 32, 33 and 34 within the central area 35 of playing board 21.

Figure 2:
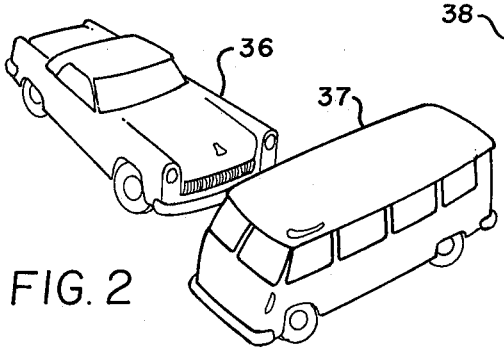
FIG. 2 is a pictorial view illustrating a preferred form of a playing piece of the present invention.
Figure 3:
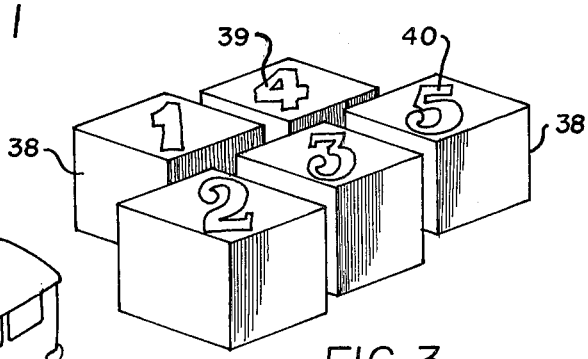
FIG. 3 is a pictorial view illustrating a preferred form of a token of the present invention.

Examples of the preferred playing pieces 36 and 37 of the present invention are shown with particularity in FIG. 2, while FIG. 3 more particularly illustrates a preferred form of token 38, each token 38 bearing on its upper surface a numeral, for exmaple, as shown, the numeral "4" at 39 and the numeral "5" at 40. The set of tokens 38 used by each player is consecutively numbered from the numeral 1.

Figure 4:
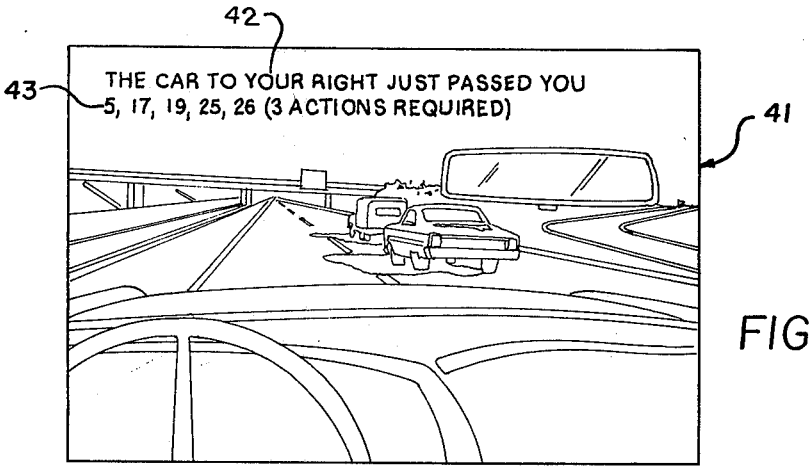
FIG. 4 is a plan view for purposes of illustration of a sample preferred picture card of the present invention showing the front side thereof.
Figure 5:
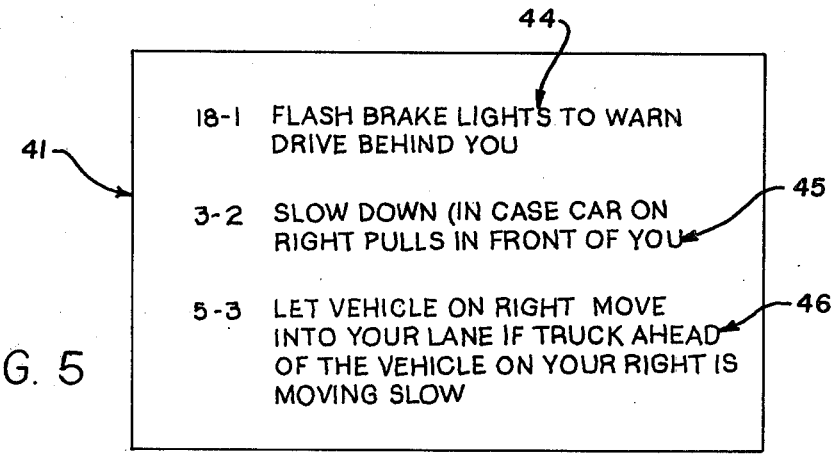
FIG. 5 is a plan view of the reverse side of the picture card of FIG. 4.

With particular reference to FIG. 4, there is shown a representative picture card 41 in accordance with the present invention. The front side of said picture card 41 (shown in FIG. 4) bears an illustration depicting a unique traffic situation. In its preferred form, the face of picture card 41 also bears a statement 42 relating to or describing said unique traffic situation and a further statement 43 setting forth certain numbered choices among the "driving" tactics at locations 29 on listings 27 and the preferred number of actions required. The statement 43 in effect constitutes "hints" and is an optional statement helpful to the average non-sophisticated game player. FIG. 5 illustrates a preferred form for the rear side of picture card 41, showing by list (at 44) that "driving" tactic 18 should be done first, then showing (at 45) that "driving" tactic 3 should be performed second and, similarly (at 46) that "driving" tactic 5 should be done thirdly. Thus the rear face of picture card 41 contains the entire "right" answer for selection of defensive driving tactics when presented with the unique driving situation shown on the front face of picture card 41.

Figure 6:
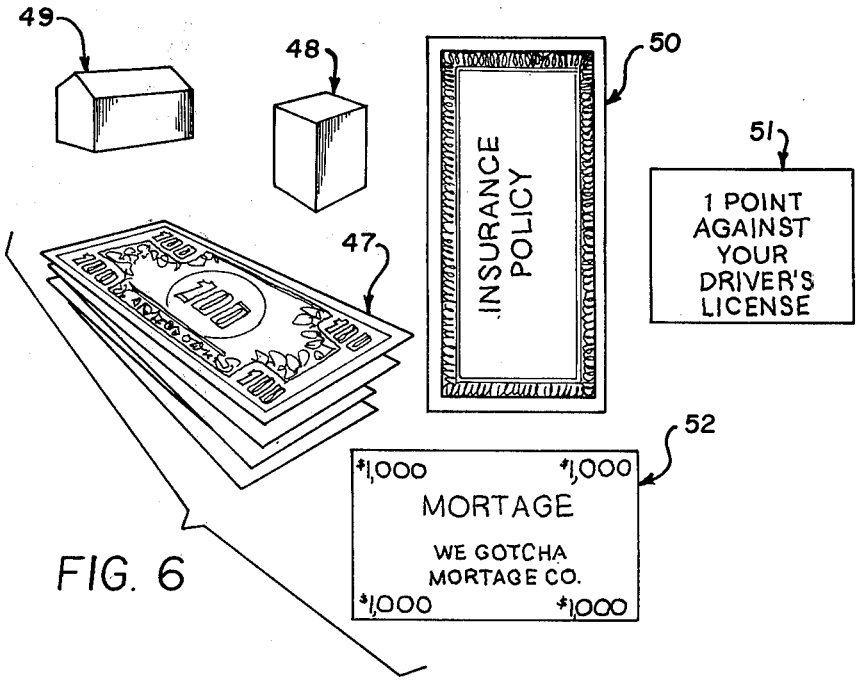
FIG. 6 illustrates other preferred materials for the possession of each player.

FIG. 6 illustrates other preferred items which are part of the game in the present invention, including play money 47, tokens 48 (for detail see tokens 38 in FIG. 3), "house" 49, insurance policy 50, drivers license point card 51, and "mortgage" 52.

Figure 7:
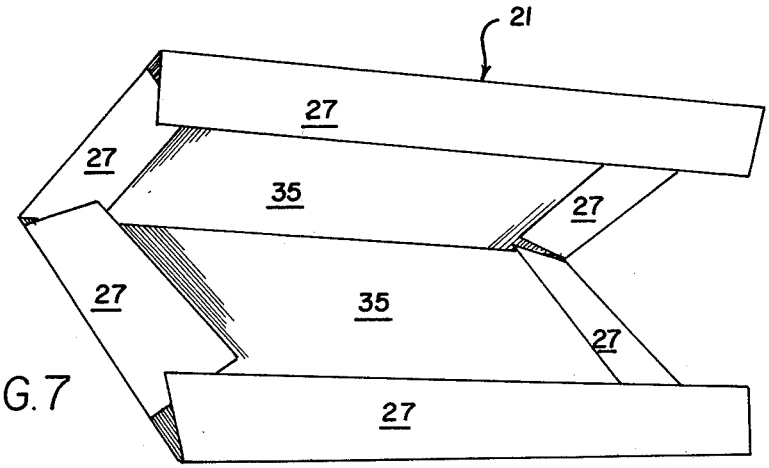
FIG. 7 is a pictorial view of the playing board of the present invention illustrating the manner in which the same may be folded.

FIG. 7 illustrates the mechanism and ease with which a preferred playing board 21 of the present invention, as shown in detail in FIG. 1, may fold for storage. It is seen that answer boards 27 fold inwardly and upwardly over the central area 35 of playing board 21 and that playing board 21 may be further folded as shown down the middle of central area 35.

Figure 8:
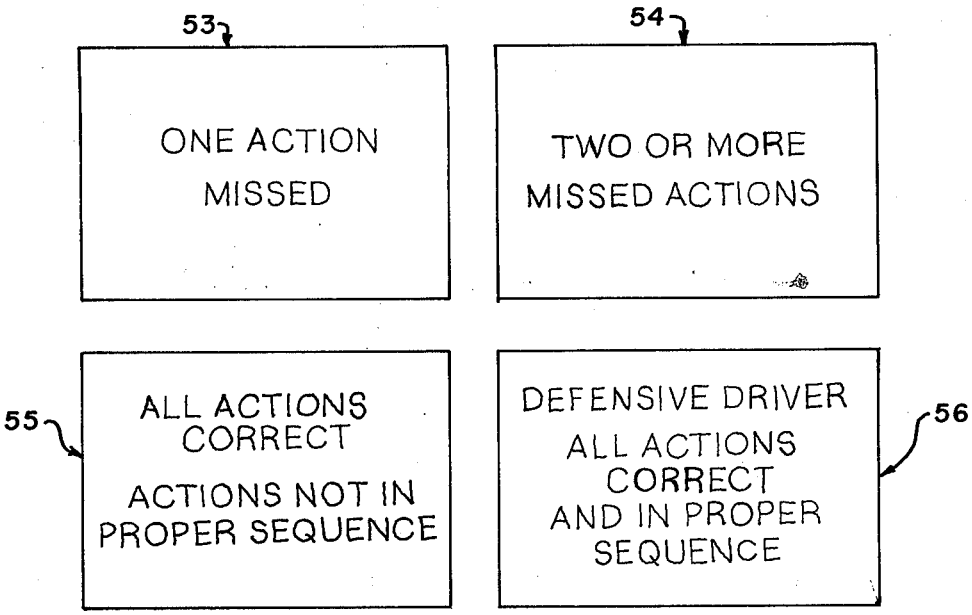
FIG. 8 illustrates the fronts of the various illustration cards of the present invention.

FIG. 8 specifically illustrates instruction cards 53, 54, 55 and 56 of the present invention (which cards may be adapted to be stacked respectively in spaces 31, 32, 33 and 34.

Figure 9:
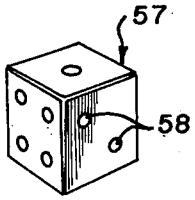
FIG. 9 is a pictorial view of a die as used in the present invention.

FIG. 9 illustrates the die 57 of the present invention, of standard form, and showing spots 58.

Figure 10:
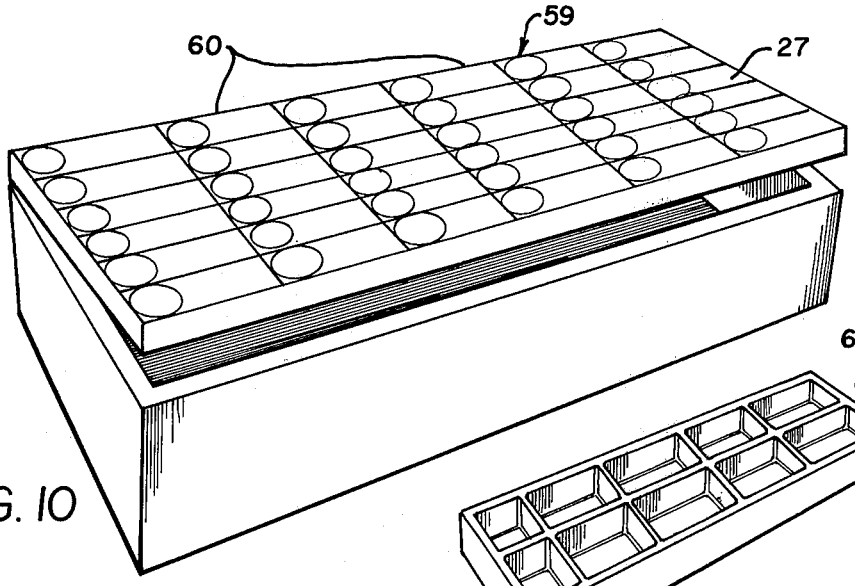
FIG. 10 is a pictorial view of the tray of a preferred embodiment of the present invention.
Figure 11:
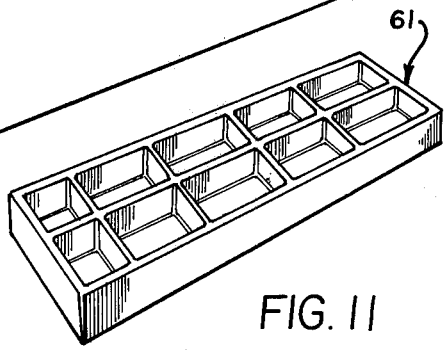
FIG. 11 illustrates a preferred tray insert or divider of the present invention.
Figure 12:
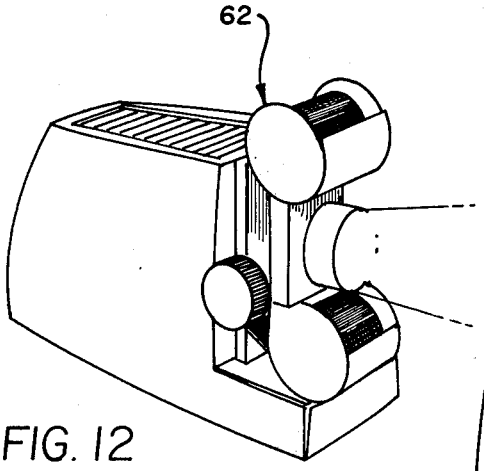
FIG. 12 illustrates a slide projector used in accordance with the present invention.
Figure 13:
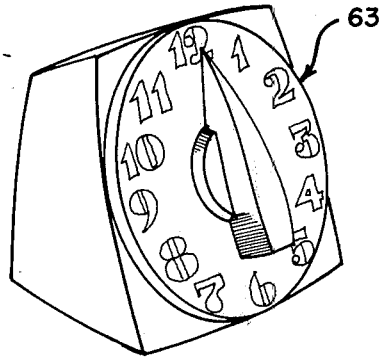
FIG. 13 illustrates a timer used in accordance with the present invention.

With specific reference to FIG. 10 there is illustrated a preferred form of answer board 27, each answer board 27 forming the lid of hollow answer board tray 59 and being hingedly connected at 60 therewith. Tray divider 61 (FIG. 11) is placed within answer board tray 59 and is divided so as to be adapted conveniently to hold the money, and other game accoutrements of each player. FIGS. 12 and 13 illustrate respectively a slide viewer 62 which may be used to project illustrations corresponding to those on the faces of picture card 41 and, in alternation the "answers" on the backs of cards 41, and timer 63 to be used by the more sophisticated players according to the present invention.

According to the preferred rules, the game of the preferred invention may be played by two, three or four players. After the playing board has been set up, the game material is distributed. Each player is given a tray (see FIGS. 10 and 11) which should contain the following: 1—set of picture cards, 8—drivers license point cards, 1—motor vehicle, 1—house, 5—indicator tokens or pegs, 1—insurance policy, 3—mortgage contracts, and play money as follows: 3—500's, 5—100's, 10—50's, 20—20's, 20—10's, and 20—5's. (The drivers license point cards are to be given to the game officer before play starts. )

Next the game officer and the first player are to be selected. This is done by each player rolling the die, and the player rolling the highest number becomes the first player, and the player to his left becomes the game officer.

The game officer is given the point cards and trays containing the defensive driver cards, one action missed cards, two or more actions missed cards, all actions correct-not in proper sequence cards, and also the balance of the play money.

Each player should place his tray at the edge of the playing board because the lid of the tray is his answer board upon which he will place his indicator tokens or pegs at the proper time during play.

Each player should make sure that his stack of picture cards are in numerical order with the picture side up. It is suggested that numbers be situated in the lower right-hand corner of each card.

Play always moves from left to right.

To begin play, the first player places his vehicle in the lane he selects at the start position. (Each player in turn must do the same when it is his turn to start. ) The first player then rolls the die and moves his vehicle forward the number of spaces indicated by the die. The player then follows the instructions given in the space upon which his vehicle comes to rest. (This may involve more than one space.)

After the player's vehicle has stopped on a space and the player has complied with the instructions, the player continues play by taking the top picture card from his stack of picture cards. (The player must not look at nor expose the reverse side of the picture card while he is examining the traffic scene, as the answers would be revealed.) As the player examines the traffic scene shown on the picture card, he is to determine what actions he would take in this particular situation if he was operating the vehicle from which the picture was taken. To assist the player, the number of actions he would be required to take is shown on the face of the picture card, as is also a series of numbers (these numbers correspond to the numbers on the player's answer board). The player selects what he believes to be the correct actions, in correct sequence, and places his indicator pegs on his answer board accordingly, peg number 1 on the first action required, peg number 2 on the second action required, etc.

After all the required indicator pegs have been placed, the player then looks at the correct answers on the reverse side of the picture card and compares them with the ones he selected on his answer board, checking not only for correctness, but also for the proper sequence.

The player is then given the proper instruction card by the game officer according to the results of the player's selection of answers, either a defensive driver card if all actions are correct and in proper sequence, a one action missed card, a two or more actions missed card, or an all actions correct—not in proper sequence card. After the player complies with the instructions on the card, his turn at play stops, and the second player begins his turn.

Once a player selects the lane for his vehicle, the vehicle must stay in the lane unless the vehicle stops on a change lanes space, or the player has in his possession a change lanes card, and desires to change lanes. When a player uses a change lanes card he must surrender the card to the game officer. Change lanes cards may be purchased by one player from another player. The price to be determined by the two players involved.

Each player in his turn must follow the instructions given on an instruction card or by the instructions given in a space a vehicle stops upon, unless the player has in his possession a card that will permit him to take some alternate action.

If a player is instructed to move his vehicle ahead a certain number of spaces and his vehicle is blocked by another player's vehicle in that lane, he may change lanes if he has a change lanes card, or he must stop his vehicle in the space directly behind the vehicle ahead. If this space is a change lanes space he can then change lanes and move his vehicle ahead the proper number of spaces. (Changing lanes does not count as a space moved.)

When a player is instructed to go to a specific place, e.g. the hospital, the drivers school, or the traffic court, and this requires that his vehicle be moved forward, the player must do so even if there are vehicles ahead of his vehicle.

When a player is instructed to move his vehicle backward, he does so regardless of any vehicles behind his vehicle, except that he cannot stop his vehicle on a space occupied by another vehicle, but must stop on the space ahead of the blocking vehicle. If this is not possible due to several vehicles being in that lane, he must move his vehicle back to the first available space behind the blocking vehicles.

When any points are issued against a player's drivers license, the game officer gives the proper number of point cards, in the proper color, to the player. When any points are removed, the player returns the proper number of cards to the game officer.

When a player is instructed to pay a certain amount of money, he pays this to the game officer, or the other players if this is specified. The player is paid by the game officer any amount of money the player is to collect, or he may collect from the other players if this is specified.

If a player has used all of his money and needs more, he may mortgage his "house" by surrendering a mortgage contract to the game officer who will give the player the amount of money the contract calls for. If the player's finances change and the player wishes to do so, he may repay the money to the game officer and redeem his mortgage contract.

When a player's insurance policy is cancelled, the player must give his insurance policy to the game officer. If the player's insurance is re-instated, the game officer returns the insurance policy to the player.

If a player receives 8 points against his driver's license he is out of the game.

When a player arrives near "home", he must roll the exact number on the die as the number of spaces he must move to get into the home space. Any number rolled on the die that is in excess of the number of spaces the player must move to get into the home space is void, and the player's vehicle remains stationary. The player must, however, complete his turn at play and select a picture card and abide by the results of the rest of his play.

The game is not over until all the players have reached home, because the object of this game is not so much to reach home quickly, but to reach home in the best possible condition. However, in the event of a tie score, the player reaching home first would be the winner over the other player.

Any player who uses all his mortgage contracts and all his play money and cannot meet a monetary obligation is out of the game.

The score of each player is tallied according to the following preferred tally sheet:

| PLAYERS DRIVERS LICENSE | |
|---|---|
| If no Points | Score 50 |
| 1 Point | Score 40 |
| 2 Points | Score 30 |
| 3 Points | Score 20 |
| 4 Points | Score 10 |
| 5 Points | Score 0 |
| **PLAYERS INSURANCE POLICY** | |
| Insurance Policy in force | Score 50 |
| Insurance Policy cancelled | Score 0 |
| **FINANCIAL CONDITION** | |
| for every $100 possessed by a player (any amount less than $100 does not score) | Score 1 |
| For every $100 owed by a player (any amount less than $100 is not computed) | Deduct 1 |
| **MORTGAGES** | |
| For any outstanding $1,000 mortagage | Deduct 1 |
| For any outstanding $3,000 mortgage | Deduct 2 |
| For any outstanding $5,000 mortgage | Deduct 3 |

As the players become more knowledgeable of defensive driving techniques, a timer should be used to limit the time allowed the player to examine the picture cards and select his answers.

The preferred game of the present invention may be made more complex in several ways. For example, each player may use two cars instead of one and, according to the preferred set of rules, the player would have the choice of moving either one car or both cars so long as the total number of spaces moved did not exceed the number rolled on the die (or the number of spaces specified by the game instruction cards). It is preferred in this event that only one car may be moved to comply with the instructions given in a space such car may come to rest upon.

According to the preferred rules, if the players desire, they may add another element, for example, for more complexity as follows. When each player begins his turn at play, each other player may wager as to the outcome of the correctness of answer selected to the traffic situation on the picture card selected by the player at turn. This may be done by each other player who wishes to wager placing a marker, say, on a stack of game instruction cards believed to correspond to the correctness of answer selected by the player at turn. Then, for example, any player whose marker is on the correct stack would receive $100 from the game officer and the players whose markers are on any other stack must pay the game officer $100 (or any amount of wager which is determined by all players at the start of the game).

With respect to the education value over and above the entertainment value of the preferred game, it is highly preferred that the picture cards used with the game show common dangerous traffic situations from the driver's view point and that the numbered indicia means (that is, the choices for driver action) include most of the common defensive driving techniques, including but not limited to: let vehicle behind pass you; eliminate obstruction to view of traffic ahead; stop well behind any large vehicle ahead of you; eliminate tailgater; center your vehicle in your lane; tap horn; increase distance between you and the vehicle ahead; scan parked vehicles for occupants; scan intersection; start right turn as far to the right as possible; get foot over brake; flash brake lights as a warning; check rearview mirror; check blindspot; allow vehicle on left or right to move into your lane; etc.

As the game of the present invention is used in its preferred form, each player, while being entertained, will greatly increase that player's defensive driving skills resulting in the incorporation into each player's everyday driving of more skillful and more safe operation of a motor vehicle.

It is further more particularly pointed out that the unique, entertaining, and educational values of the board game apparatus of the present invention are due in large part to the unique combination of chance and skill provided by each turn, according to the preferred set of rules, resulting in a chance instruction obtained from the board by rolling a die and a further instruction (which improves with the skill of the player) being selected according to the skill of the player in determining the sequence and type of appropriate defensive driving skills to be applied to the traffic situation on the picture card selected.

The present embodiment of this invention is to be considered in all respects as illustrative and not restrictive, the scope of the invention being indicated by the appended claims rather than by the foregoing description; and all changes which come within the meaning and range of equivalency of the claims are therefore intended to be embraced thereby.

I claim:

1. Board game apparatus comprising:

(a) one or more playing boards including playing areas;

(b) means dividing said playing areas into at least two sectors;

(c) the first said sector being a "driving" track around the center of a said board, said driving track including a plurality of "driving" lanes;

(d) first means partitioning each said driving lane into a plurality of first discrete areas, the number of said first discrete areas in each said lane being equal;

(e) second means partitioning the second said sector into a plurality of second discrete areas;

(f) a plurality of second indicia means that identify each said second discrete area, each said second indicia means including a unique tactic number in association with a unique described "defensive driving" tactic;

(g) a first plurality of illustrations, each said illustration depicting a unique vehicle traffic driving situation from the point of view of the driver, and, in association with each said illustration, a listing of the corresponding preferred "defensive driving" tactics called for by said unique vehicle traffic driving situation;

(h) at least two pluralities of game instruction cards, each plurality being adapted to be shuffled and stacked;

(i) a plurality of playing pieces adapted to be received in said first discrete areas, each said playing piece being visually distinguishable from each other said playing piece;

(j) a plurality of tokens adapted to be received in said second discrete areas;

(k) token indicia means for uniquely identifying and numbering each said token consecutively; and (l) at least one die.

2. The board game apparatus of claim 1 wherein each said illustration comprises a picture card of the type adapted to be shuffled and stacked in association with other said picture cards.

3. The board game apparatus of claim 2 wherein the front of each said picture card depicts a unique vehicle traffic driving situation.

4. The board game apparatus of claim 3 wherein the back of each said picture card includes said listing of the corresponding preferred "defensive driving" tactics called for by said unique vehicle traffic driving situation.

5. The board game apparatus of claim 4 wherein said listing includes, in association with each said corresponding preferred "defensive driving" tactic, a said unique tactic number.

6. The board game apparatus of claim 5 wherein each said corresponding preferred "defensive driving" tactic in said listing on said back of said picture card includes, in association therewith, a first identifying unique consecutive number corresponding to the order in which each said corresponding preferred "defensive driving" tactic in said listing is preferred to be taken as called for by said unique vehicle traffic driving situation depicted on said front of said picture card.

7. The board game apparatus of claim 6 wherein each said front of each respective said picture card includes a plurality of "hint" numbers, said plurality of "hint" numbers including at least each said unique tactic number associated with each said corresponding preferred "defensive driving" tactic in said listing on the back of each said respective picture card.

8. The board game apparatus of claim 7 wherein each picture card comprising said first plurality of illustrations includes a second indentifying unique consecutive number on the said front of each said picture card.

9. The board game apparatus of claim 1 wherein said first said sector is included on a first playing board and said second said sector is included on a second playing board separate from said first said playing board.

10. The board game apparatus of claim 9 wherein said second said playing board comprises the lid of a tray adapted and arranged to hold sorted accoutrements associated with the said board game apparatus.

* * * * *